United States Patent [19]

Kenny et al.

[11] Patent Number: 4,834,288

[45] Date of Patent: May 30, 1989

[54] PULSED SLIT NOZZLE FOR GENERATION OF PLANAR SUPERSONIC JETS

[75] Inventors: Jonathan E. Kenny, Somerville; Timothy Woudenberg, Eastham, both of Mass.

[73] Assignee: Tufts University, Medford, Mass.

[21] Appl. No.: 452

[22] Filed: Jan. 5, 1987

[51] Int. Cl.[4] ..... B05B 1/08; B05B 15/00; A62C 31/02; F17D 3/00

[52] U.S. Cl. ..... 239/99; 239/395; 239/396; 239/397; 239/397.5; 137/624.13

[58] Field of Search ..... 137/624.13, 624.15, 137/624.16; 239/99, 102.1, 395–397.5, 568, 596

[56] References Cited

U.S. PATENT DOCUMENTS

| | | | |
|---|---|---|---|
| 1,889,476 | 11/1932 | Hickman et al. | 137/624.13 |
| 1,921,380 | 8/1933 | Barker | 137/624.15 |
| 2,245,553 | 6/1941 | Biedermann | 137/624.13 X |
| 2,974,681 | 3/1961 | Whitehurst | 137/624.13 |
| 3,103,941 | 9/1963 | Watters | 137/624.13 X |
| 3,384,117 | 5/1968 | Hansel | 137/624.13 |

FOREIGN PATENT DOCUMENTS

| | | | |
|---|---|---|---|
| 1550400 | 9/1969 | Fed. Rep. of Germany | 137/624.13 |

OTHER PUBLICATIONS

Amirav et al., Journal Chem. Phys. 75(6), 3151, (1981).
Bersohn et al., Journal Chem. Phys. 79(5), 2163, (1983).
Amirav et al., Chemical Physics Letters, vol. 94, #6, 545, (1983).
Lovejoy et al., Chemical Physics Letters, vol. 127, No. 4, 374, (1986).
Lovejoy et al., Journal Chem. Phys. 85(9), 4890, (1986).

*Primary Examiner*—Andres Kashnikow
*Assistant Examiner*—Patrick N. Burkhart
*Attorney, Agent, or Firm*—Ernest V. Linek; David G. Conlin

[57] ABSTRACT

The present invention relates to generation of pulsed supersonic gas flow through a slit-shaped nozzle, useful in a wide range of applications, including particle separation, wind-tunnel studies, and especially spectroscopic studies of cold, gas-phase molecules. Specifically, the present invention is directed to a pulsed slit nozzle, which has a high length to width ratio, affording high sensitivity in spectroscopic applications.

In addition, the present invention provides low dead volume, superior sealing properties, ease of actuation, heatability, uniform flow, ease of construction and maintenance, chemical inertness and long life.

5 Claims, 2 Drawing Sheets

PULSED SLIT NOZZLE FOR GENERATION OF PLANAR SUPERSONIC JETS

BACKGROUND OF THE INVENTION

The present invention relates to the generation of pulsed supersonic gas flow from a slit-shaped (i.e., long and thin) orifice.

Supersonic jets produce cold, gas-phase molecules which move along well defined streamlines with a narrow velocity distribution. These gas-phase molecules are usually generated by expanding a warm, high pressure gas across an orifice into a vacuum chamber.

Some of the more important applications of supersonic jets include isotope enrichment, wind-tunnel experiments, and molecular beam studies. See, for example, Feen et al., "*Free-Jet Experiments in a Spacecraft Environment*", Final Report on Contract #954327 between Calif. Institute of Technology Jet Propulsion Laboratory and Relay Development Corporation.

Especially important as both an application and a diagnostic tool for supersonic jets has been the field of molecular spectroscopy, in which the interaction between the molecules in the jet with one or more beams of light is studied. (See, for example, Levy, *Ann. Rev. Phys. Chem.*, 31: 197 (1980); Levy, *Scientific American*, Feb., 1984, p. 96; Vaida, *Accts. Chem. Res.*, 19, 114 (1986)).

The use of supersonic jets of rare gases seeded with large molecules provides a source of internally cold, isolated large molecules which can be probed by a variety of spectroscopic techniques; see, for example, Amirav et al., *Anal. Chem.*, 54: 1666 (1982).

One of the more popular techniques has been laser-induced fluorescence (LIF). In LIF, the high intensity of a laser beam compensates for the relatively low molecular density in the jet, making excitation of molecules easy, while fluorescence detection provides high sensitivity. Since supersonic jets eliminate vibrational sequence congestion as well as rotational congestion in the spectra of polyatomic molecules, linewidths of spectral features are often reduced by factors of 1000 or more, compared to conventional spectroscopy, making high-resolution studies of molecular energetics and dynamics possible. For examples, see Fitch, et al., *J. Chem. Phys.*, 70: 2019 (1979); Amirav, et al., *J. Chem. Phys.*, 71: 2319 (1979); Hopkins, et al., *J. Chem. Phys.*, 72: 5039 (1980); Oikawa, et al., *J. Phys. Chem.*, 88: 5180 (1984); Felker and Zewail, *J. Chem. Phys.*, 82: 2994 (1985).

While many of the jets described in the literature have circular orifices, an important variation on this apparatus involves the use of a slit-shaped orifice. Slit-shaped orifices produce supersonic jets having important differences in gas properties, compared to jets from circular orifices; these properties have been characterized theoretically and experimentally, for example, in Sulkes et al., *Chem. Phys. Lett.*, 87: 515 (1982); Beylich, in Paper No. 111 and Dupeyrat, in Paper No. 135, delivered at the Twelfth International Symposium on Rarefield Gas Dynamics, Charlottesville, Va., July 7–11, 1980.

One of the major advantages of a slit-shaped orifice over a circular one is that, for a given total gas flow rate, the slit provides a much greater interaction length with a light beam crossing the jet at right angles. For most types of spectroscopy, this results in important gains in sensitivity. For direct absorption measurements, in particular, slit nozzles have made some experiments feasible for the first time. See, for example, Amirav and Jortner, *J. Chem. Phys.*, 82: 4378 (1985).

Regardless of the shape of the orifice, supersonic jets require high pressure ratios across the orifice, which are normally achieved by maintaining a vacuum on the downstream side of the orifice. Since the flow rate through the orifice is large, the vacuum pumps required to handle the flow of a continuously operating jet can be large and expensive. In many applications, it is acceptable or even desirable to operate the jet intermittently (see, for example, Zwier, et al., *J. Chem. Phys.*, 78: 5493 (1983)), reducing the size of the vacuum pumps required. Thus, the ability to rapidly switch the jet on and off can have great practical importance.

Circular orifices can be rapidly opened and closed using valves of various designs, several available commercially. In contrast, fast, effective valves for slit-shaped orifices are uncommon. Only one has been described in detail in the literature; and this device is addressed herein below in order to demonstrate both its utility and its shortcomings, as well as to compare it to the present invention.

Amirav, et al., *Chem. Phys. Lett.*, 83: 1 (1981), described a pulsed slit nozzle for the production of pulsed, planar supersonic jets. The source was constructed from two concentric cylinders, with matching slits of dimensions 0.2 mm wide and 35 mm long machined in each cylinder, parallel to the cylinder axis. The internal cylinder (70 mm long, diameter 20 mm, wall thickness 0.5 mm) was spun by a motor. The external cylinder had an inside diameter which matched the outside diameter of the internal cylinder with a tolerance of 0.02 mm. $MoS_2$ powder was used as a lubricant between the cylinders.

The pulsed, supersonic nozzle slit source had a repetition rate of 12 Hz and a pulse wdith of 150 microseconds. The source could be heated up to about 200° C. A sample of the molecules was placed near the inner cylinder, heated to give a vapor pressure of about 0.1 Torr, and mixed with Ar gas in the pressure range of about 20 to 100 Torr, which was fed into the inner cylinder.

The pumping system consisted of two mechanical pumps, with the pumping speed of the system being about 700 liter/min. Light from a tunable pulsed dye laser crossed the supersonic gas expansion parallel to the long axis of the slit at a distance ranging from 6 to 15 mm from the source. The temporal coincidence between the laser pulses and the supersonic gas pulses was achieved by use of an IR optical switch and a variable delay unit.

In typical applications, the authors performed absorption and/or LIF studies on medium to large-sized organic molecules. See, for example, Amirav, et al., *Chem. Phys.*, 67: 1 (1982); Bersohn, et al., *J. Chem. Phys.*, 79: 2163 (1983); Sonnenschein et al., *J. Phys. Chem.*, 88: 4214 (1984).

This design represented the first successful operation of a pulsed nozzle using a long, thin orifice.

However, theoretical considerations, as well as our own experience with a nozzle built to similar specifications, point out a number of problems with the design.

For example, gas leakage when the nozzle was closed (the static leak) was a serious problem. To some extent, this is an inherent problem in all pulsed slit nozzles: at the very least, the nozzle must seal around its entire perimeter; for a given orifice area, this problem is far worse than in the case of a circular orifice, which, in fact, has a minimum perimeter: area ratio. The greater the aspect ratio (ratio of length to width) of the slit, the farther from this minimum is the actual ratio, and slit nozzles are usually employed in applications where very large aspect ratios are desirable.

However, in the Amirav design, a seal must be maintained around the entire surface area of the inner cylinder (i.e., its cylindrical surface and both ends); this is much greater than the minimum sealing problem, involving as it does the regions where bearings must be located and gas supply line and motor shaft must be connected. The authors noted that their device operated with a 0.02 mm gap between the two cylinders; this can represent a substantial leak at high gas pressures, and the situation is likely to be exacerbated with wear.

Another potential problem is the use of a motor to rotate the inner cylinder. If the motor is located inside the vacuum chamber, it must be equipped with a pressurized housing containing air or some other gas to prevent burnout; if it is outside the vacuum chamber, a rotary-motion feedthrough is required. These alternatives add complexity, cost, and/or potential leaks to the system.

Finally, as far as can be determined from published accounts, the Amirav et al. pulsed slit was operated at a more or less constant angular velocity. Thus, regardless of the actual value of this velocity, the gas was on for a fixed fraction of the time (defined as the duty cycle), determined by the width of the slits and the diameter of the matched cylindrical surfaces. The only way to change the duty cycle (for example, if one desired to use higher backing pressure without a concomitant rise in the pressure in the vacuum chamber) would be to remachine the entire device.

Furthermore, external control of exactly when the nozzle is open is very difficult to achieve with an electric motor drive, as it requires a means for fine control of acceleration and/or deceleration to ensure that the slits cross at exactly the desired time.

The present invention addresses and mitigates the problems of this prior art device.

SUMMARY OF THE INVENTION

The present invention is directed to an improved pulsed slit nozzle, especially useful in applications involving free-jet absorption spectroscopy.

The basic requirement of the present invention is that a valve be incorporated into a slit nozzle source which may have a large aspect ratio. The valve should be very near to the orifice; any dead volume between the two will result in deterioration of flow properties. The valve should seal well when closed, and it should open and close easily and quickly. Flow should be uniform across the length of the slit. External control of the valve (both repetition rate and duty cycle) should be easy and reliable. The valve should be easy to fabricate and maintain, and have a long life.

Because the polyatomic molecules of interest to spectroscopists often have low vapor pressures at ambient temperatures, the valve must be heatable; the materials of construction should be inert with respect to chemical reactions with the sample.

The prior art device described above satisfies the requirements of large aspect ratio, low dead volume, heatability, uniformity, and adjustable repetition rate.

The present invention, however, offers substantial advantages in sealing properties; ease of external control; adjustability of duty cycle; easy of fabrication, use, and maintenance; and chemical inertness.

Like the prior art device, the pulsed slit nozzle of the present invention is based on two concentric cylinders, each with a long, thin slot cut parallel to the rotation axis. This aspect of the design ensures low dead volume and permits large aspect ratios.

In contrast to the prior art device, however, the present invention employs a short stroke (about 13° of arc) rather than continuous revolution to open and close the orifice. This feature significantly reduces sealing problems, since it requires only the minimum seal, i.e., around the perimeter of the orifice, to be maintained. It also allows use of a solenoid to impart motion; solenoids can be readily operated in vacuum with no special provisions for their cooling; they are readily and inexpensively available in sizes required to open and close the valve quickly; and they are easily externally controlled with regard to repetition rate, velocity of stroke, and exact time of opening.

Separate control over repetition rate and velocity of stroke means that the duty cycle of the device of the present invention can be varied continuously over the complete range (from zero to one) without any mechanical modifications.

Control over exact opening time means that synchronization with other events (e.g., firing of a pulsed laser or triggering of a detector) is easy, and may be readily accomplished by a computer or other instrument controller.

Another advance over the prior art device is the construction of the two sealing surfaces of the inner and outer cylinders out of different materials, one of which is self-lubricating (Teflong, in the preferred embodiment). This advance provides a number of important advantages. First, both materials may be chosen to be chemically inert to the samples; the absence of any lubricant mitigates problems of contamination and/or chemical reaction of the sample with the lubricant. Also, the self-lubricating properties provide long life and freedom from maintenance. Even more important, the different materials in general have different thermal expansion coefficients, so that the seal between them is temperature-tunable. If a large difference in expansion coefficients is chosen, a small change in temperature (which is usually inconsequential with respect to changes in the properties of the free jet) can be used to increase or decrease the gap between the cylinder surfaces. This feature is useful in wearing in the surfaces upon initial installation, providing a convenient tradeoff between goodness of seal and torque requirements for motion, and allowing a seal to be maintained without deterioration as the components undergo wear with use.

Finally, provision has been made in the present invention for easy replacement of the less durable component of the valve seal.

As described further below, a prototype instrument has been built according to this design, and has exhibited the desired simplicity of construction, operation and maintenance.

BRIEF DESCRIPTION OF THE DRAWINGS

FIG. 9(*b*) illustrates graphically another pulse pattern for the FIGS. 1 and 2 type device. In this case, the flow rate vs. time is at twice the repetition rate of that described in FIG. 9(*a*). Note that total flow (indicated by the area under the curve) is the same as in FIG. 9(*a*), since the pulses are half as wide but twice as frequent.

FIG. 10(*b*) illustrates graphically another pulse pattern for the device of the present invention. In this case, the flow rate vs. time is at twice the repetition rate shown for FIG. 10(*a*). In this device only the rest time between strokes needs to be changed to affect this function, and thus the pulse shape can be kept the same as in FIG. 10(*a*) if desired. Total flow as depicted is thus twice that of FIG. 10(*a*) since the flow per pulse is the same.

FIG. 10(*c*) illustrates graphically another pulse pattern for the device of the present invention. In this case, the flow rate vs. time is at the same pulse frequency as shown in FIG. 10(*a*), but with a shorter pulse duration. Such a pulse pattern is achieved by changing the electrical characteristics of the pulse which activates the solenoid.

DETAILED DESCRIPTION OF THE PREFERRED EMBODIMENTS

The prior art device and the device of the present invention are set forth in FIGS. 1 & 2, and FIGS. 3 & 4, respectively.

It should be noted that the pictorial representation and description of the prior art device are based on the very brief description provided by Amirav, Even, and Jortner in *Chem. Phys. Lett.*, 83: 1 (1981).

No pictures or diagrams have been provided by those authors, nor have any details pertaining to the construction, connections to motors, gas feeds, etc. been provided. It is believed, however, that this description is sufficient for the comparisons made between the device of the present invention and the Amirav et al. device.

Common to both designs is a concentric cylinder arrangement, where a stationary outer cylinder, 12, is fitted with a pressurized rotatable inner cylinder 14. Both cylinders have a slit, 16, machined parallel to the cylinder axis, so that, when the slits are aligned, gas may expand from the slit shaped orifice.

In the present invention, the inner cylinder is different in two ways.

First, since it does not rotate a full 360°, the part of the cylindrical surface not involved in sealing may be eliminated, thus lowering the weight and reducing torque requirements. However, in order to achieve a balanced load, the section diametrically opposed to the sealing surface is retained. Thus, the inner and outer cylinders come into contract only over two small regions of their surfaces; these regions provide sealing of the valve as well as acting as a bearing for the rotary motion.

Second, although the inner and outer cylinders are conveniently constructed from the same material (a metal, e.g., brass or stainless steel), a thin, replaceable "shoe" of a different material, e.g., Teflon, is affixed to the parts of the inner cylinder which contact the outer one. This self-lubricating material obviates the need for $MoS_2$ or any other dry or wet lubricant, provides an effective sealing and bearing surface, and makes the gap between inner and outer cylinder temperature tunable.

The prior art apparatus (see FIGS. 1 and 2) used cylinders (12 and 14) lubricated with molybdenum sulfide powder. The inner cylinder 14 was rotated with an electric motor at about 700 rpm.

In the present invention, a rotary solenoid, when driven by an appropriate electrical pulse, imparts a single stroke of motion to the inner cylinder, moving it from one rest position, $\theta = -6.5$ degrees from reference, to the other rest position, $\theta = +6.5$ degrees from reference, where reference is the position in which the slits are aligned. A single gas pulse is thus delivered per stroke, and the next stroke imparts the opposite motion to the cylinder, resulting in another gas pulse. Pulse repetition rates achievable in the prior art apparatus are easily duplicated.

Figure 1:
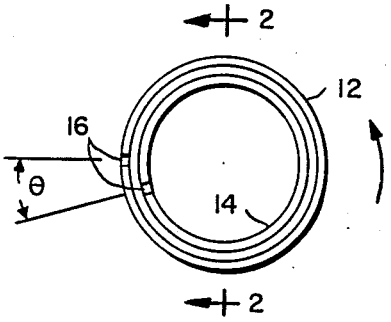
FIG. 1 PRIOR ART
FIG. 1 is a cross-sectional view of one prior art type expansion jet, comprising rotatable cylinders, with a $MoS_2$ seal therebetween.
Figure 2:
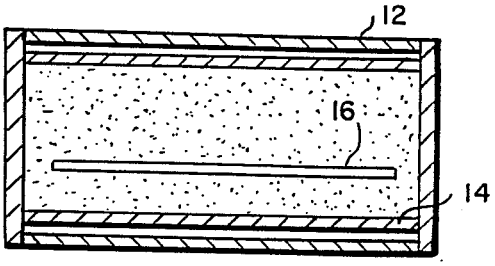
FIG. 2 PRIOR ART
FIG. 2 is a front view of the inner cylinder of the prior art type expansion jet of FIG. 1(*a*) showing the position and size of the slit.
Figure 3:
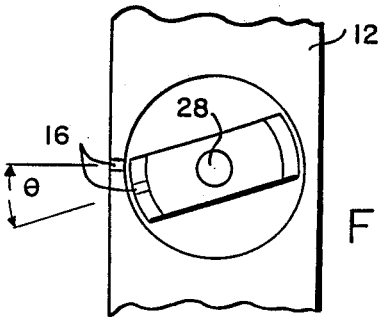
FIG. 3 is a cross-sectional view of the pulsed slit expansion nozzle of the present invention, showing the sealing surfaces and indicating the reciprocal nature of motion.
Figure 4:
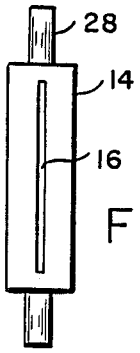
FIG. 4 is a front view of the inner cylinder of the pulsed slit expansion nozzle of the present invention showing the position and size of the slit and the position of the sealing means.

As set forth above, the prior art and the current invention are contrasted in FIGS. 1 and 3 and in FIGS. 2 and 4.

FIGS. 1 and 3 illustrate cross-sectional views showing the inner and outer cylinders and indicating the type of motion (of the inner cylinder) in each case. Also, the region in which a leak-proof seal is required is stippled in FIGS. 1 and 3, as well in FIGS. 2 and 4, which show the front view of each inner cylinder.

The entire gap between the cylinders provides a channel for leakage in FIG. 1, that is, the full 360° around the circular cross-section; and out beyond the ends of the slit until provision is made for sealing the gap. This is the region filled with dry $MoS_2$ powder; it is clear that the sample gas and the lubricant will mix in this region, and that the powder will tend to be flushed out of the volume by the flowing gas, necessitating periodic servicing.

Function and wear would be excessive unless a gap were left between the cylinders, so the minimum leak rate is determined by the skill of the machinist in preparing the mating surfaces and installing bearings which ensure proper alignment.

In FIG. 3, by contrast, sealing is required over a much smaller region, and is preferably accomplished by ensuring contact between the cylindrical surfaces in this region, and in the corresponding region diametrically opposed to it.

A relatively small fraction of the circumference is thus used; furthermore, the sealing surface of the inner cylinder is fabricated from a self-lubricating material like Teflon; the result of which is that a negligible leak rate may be maintained without placing an undue frictional load on the driving solenoid.

By contrast, the valve in FIGS. 1 and 2 operates with a motor turning the inner cylinder at a constant angular velocity.

Figure 5:
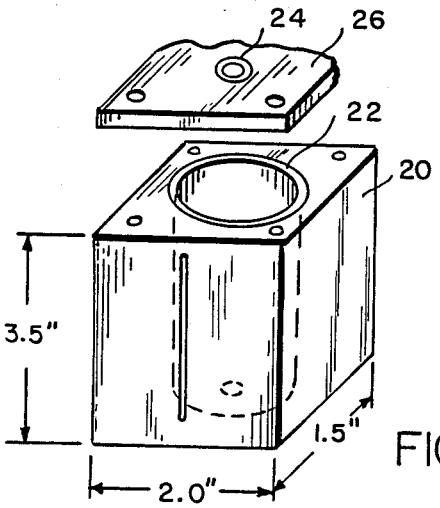
FIG. 5 is a longitudinal plan view of the outer cylinder portion of the pulsed slit expansion nozzle of the present invention.

FIG. 5 illustrates the preferred arrangement of the outer cylinder portion 20, the O-ring seal groove 22, the oil seats and bearing seals 24, and the lid (or top) 26 of the pulsed slit nozzle of the present invention.

Figure 6:
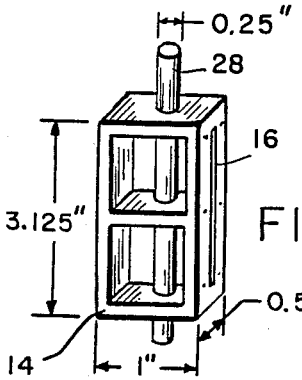
FIG. 6 is a longitudinal view of the rotor or inner cylinder portion of the pulsed slit expansion nozzle of the present invention.

FIG. 6 illustrates the preferred arrangement of the rotatable inner cylinder 14 showing the slit 16 and the axis of rotation 28. Also set forth are preferred dimensions (in inches).

Figure 7:
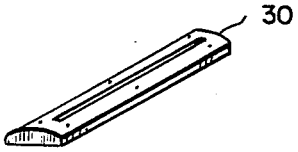
FIG. 7 is a longitudinal view of one of the two Teflon shoe sealing means employed on the faces of the inner cylinder portion of the pulsed slit expansion nozzle of FIG. 5.

FIG. 7 illustrates the preferred Teflon shoe sealing means 30 employed on the faces of the inner cylinder 14 of the pulsed slit expansion nozzle of FIG. 6.

Figure 8:
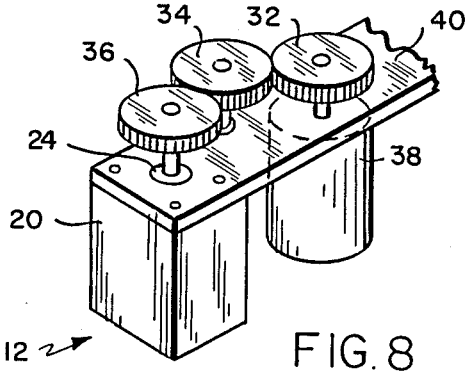
FIG. 8 illustrates one preferred driving mechanism for imparting motion to the pulsed slit expansion nozzle of the present invention.

FIG. 8 illustrates one preferred driving mechanism for imparting motion to the pulsed slit expansion nozzle of the present invention. As illustrated, this driving mechanism comprises a series of interconnected gears 32, 34, and 36, also known as the drive gear, idler gear and driven gear, respectively. A driving means, 38, such as a rotary solenoid is mounted to a means such as bracket 40, to enable transfer of motion therefrom through the gear arrangement to the slit assembly 12.

Figure 9:
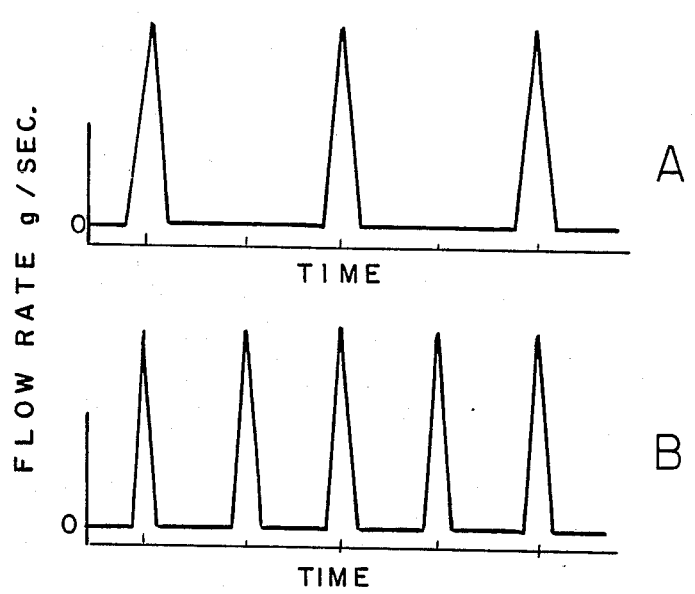
FIG. 9 PRIOR ART
FIG. 9(*a*) illustrates graphically one typical pulse pattern of the prior art (FIGS. 1 & 2) type device, in terms of Flow rate (g/sec) versus time.

In FIGS. 9(*a*) and 10(*a*), the idealized flow from each source is plotted versus time.

For the sake of comparison, it is assumed that the instantaneous angular velocity, w, and the inner cylinder diameter of the device in FIG. 3 are equal to the angular velocity and diameter of the inner cylinder in FIG. 1.

If this is true, and, furthermore, if the slits in the inner and outer cylinders of both devices are identical, then the shape of a gas pulse from either source is as shown in the Figures, i.e., the same in both cases.

Furthermore, one could operate both devices at the same repetition rate, and achieve identical performance (neglecting leakage).

Now, suppose one wanted to increase the repetition rate.

In FIG. 9(*b*), this could only be achieved by increasing w, which simultaneously shortens the duration of an individual pulse.

Figure 10:
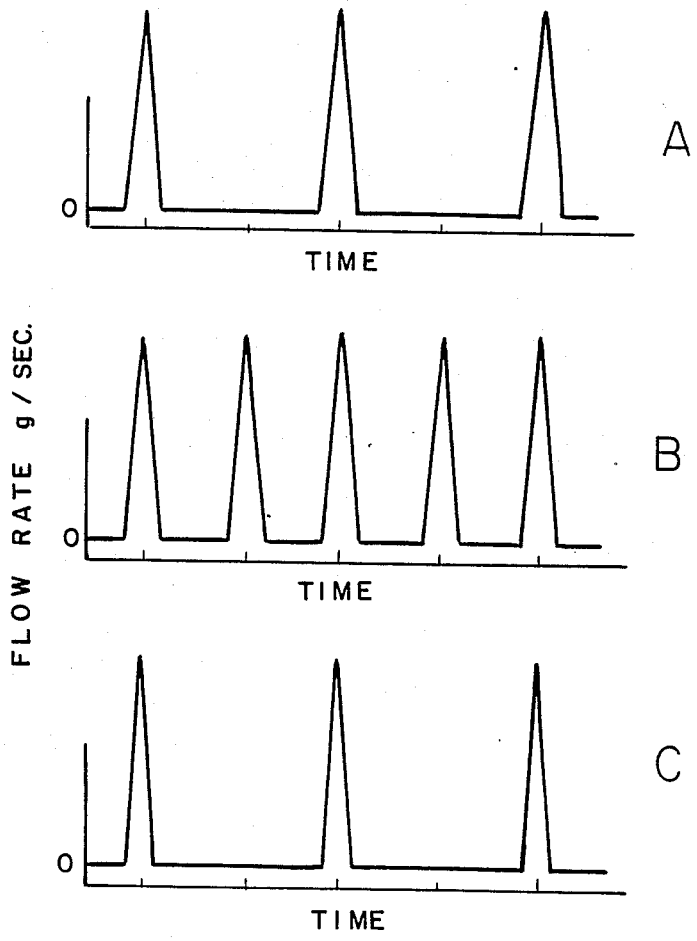
FIG. 10(*a*) illustrates graphically one typical pulse pattern of the device of the present invention, in terms of Flow rate (g/sec) versus time.

In FIG. 10(*b*), the repetition rate can be increased by increasing the number of strokes per unit time; each stroke could be identical to those delivered at the slower repetition rate, giving an unchanged gas pulse shape.

Suppose, on the other hand, that narrower gas pulses are desired, say, half of the original duration.

The device in FIGS. 1 and 2 can accomplish this, as we have been in FIG. 9(*b*), only by simultaneously doubling the repetition rate.

In FIG. 10(*c*), the repetition rate can be kept the same, but the pulses shortened by changing the electrical pulses which drive the solenoid. This independent control over pulse duration and frequency provides considerable flexibility to the user.

A further advantage of this reciprocating motion design is that it employs a solenoid, which runs well in a vacuum, as opposed to an electric motor.

Electric motors of all types are well known for their tendency to overheat in a vacuum (see, Engel, et al., *Rev. Sci. Instrum.*, 56: 8 (1985), requiring them to be placed in a can of atmosphere with rotary vacuum feedthroughs, thus resulting in unnecessary complexity.

Tuning the sealing tolerances has greatly improved the sealing capability of the nozzle of the present invention. The small variation of temperature required to maintain the seal has negligible effect on jet characteristics.

In the currently preferred embodiment of the present invention, the shoes are made of Teflon which provides a good seal as well as some dry lubrication. The full open condition is at the midpoint of the angle of travel, providing short pulse times.

The present invention will be further illustrated with reference to the following examples which aid in the understanding of the present invention, but which are not to be construed as limitations thereof.

EXAMPLE 1

Preparation of Slit Prototype

The construction of the pulsed slit nozzle prototype is divided conceptually into four parts:

(a) The outer cylinder, which includes one of the two sealing surfaces, the slit orifice, the mixed gas inlet, rotor bearing seats, the cylinder lid and the shaft seal.

(b) the rotor, which includes the precision stainless steel shafting, the shaft bearings and the support for the Teflon shoes.

(c) The Teflon shoes, which include the second sealing surface and its attachment to the rotor; and (d) The driving mechanism.

(a) Outer Cylinder (See FIG. 5).

A rectangular block of brass measuring 1.5"×2.0"×3.5" had a 1.125" diameter blind hole bored 3" deep along the long axis of the block.

A 2.5"×0.010" slit was cut through the broad face of the block parallel to the axis of the cylinder.

Provision was made for covering the slit with a smaller one that could be attached to the front of the block.

Also machined into the brass block were an O-ring groove, at the top of the brass block and concentric with the 1.125" hole, which provides sealing of the cylinder lid; a 1/16"NPT off-axis gas feed into the bottom; four ¼" holes drilled from the bottom for the insertion of cartridge heaters; four ¼–20 blind tapped holes in the side of the block for attaching support brackets; and a 5/16" diameter ×3/16" deep bearing seat machined into the bottom of the 1.125" diameter blind hole.

The cylinder lid was produced from a ½"×2"×4.5" brass plate. The underside was polished to form a good seal with the O-ring at the top of the brass block.

Into the top of the plate was machined a 5/16" diameter ×7/16" deep bearing seat and a concentric ¾" diameter ×¼" deep oil seal seat. Also machined in the plate were four ¼–20 clearance holes for attaching the lid to the block and two dowel pin holes for positioning of the lid to the block.

The internal surface of the outer cylinder was carefully polished to a high degree of concentricity and smoothness. Sealing of the cylinder was achieved by a standard NPT gas fitting on the bottom, an O-ring seal between the block and the lid, a viton shaft seal in the lid and the slit seal which is described in great detail infra.

(b) The Rotor (See FIG. 6).

A rectangular plate of brass ($\frac{1}{2}''\times 1''\times 3.125''$) had two large rectangular holes milled through the broad face, a $\frac{1}{4}''$0 hole bored through the long axis and a $3/32''\times 2\ 3/8''$ slit milled through the narrow face.

A $\frac{1}{4}''$ diameter $\times 4''$ long precision stainless steel shaft was pressed into the bored hole and six 2–56 holes were tapped into each of the narrow faces in order to attach the shoes.

Two precision sealed frictionless bearings were pressed onto each end of the stainless steel shaft. The top bearing was pressed into the outer cylinder lid.

The outer diameter of the bottom bearing was a loose press fit with the bottom seat to facilitate easy disassembly.

(c) Teflon Shoes (See FIG. 7).

Two Teflon strips ($\frac{1}{2}''\times 0.060''\times 3.125''$) had six 2–56 countersunk clearance holes drilled to match the tapped holes of the slit rotor. The shoes were then installed on the rotor and a slit 0.020" wide cut through the one which was mounted over the milled slit of the rotor.

The rotor was then turned down to size by repetitive material removal and testing inside the outer cylinder until a good seal was achieved at the desired temperature (100° C. in the presently preferred embodiment).

(d) The Driving Mechanism (See FIG. 8).

The shaft of the inner cylinder protruded beyond the cylinder lid and through the mounting bracket. It was fitted with a gear, which was driven by the geared shaft of the rotary solenoid, which was attached to the mounting bracket with its shaft parallel to that of the cylinder.

In the currently preferred embodiment, a third parallel shaft fitted with an idler gear was located between the drive shaft and the driven shaft; this provided a convenient way to adjust gear ratios and to separate components spatially.

EXAMPLE 2

Sealing Characteristics

Maintenance of a good seal is crucial to the performance of the slit nozzle of the present invention. This seal design provides the ability to maintain close tolerance through temperature tunability.

(A) Difference in Thermal Expansion Coefficient

The thermal expansion coefficient of brass is many times less than that of Teflon (Brass: $1.9\times 10^{-5}$ per degree C., Teflon: $17.\times 10^{-5}$ per degree C.).

Components of the present device are machined to provide a small amount of clearance between the mating surfaces of the cylinders. When the slit nozzle assembly is heated, the Teflon expands to fill the clearance between the brass rotor and outer cylinder, providing temperature tunable sealing tolerances.

For the discussion below, it is useful to define the following symbols:

T=thickness of Teflon shoe
S=spacing between brass pieces
d=clearance between shoe and outer cylinder
$T_o$, $S_o$, $d_o$ are the values of T, S, and d at the operating temperature of 100° C.
$\Delta t$=temperature rise
$\Sigma_b$=thermal expansion coefficient of brass
$\Sigma_t$=thermal expansion coefficient of Teflon The fundamental relation is $$S=T+d. \qquad \text{eqn 1}$$

When the temperature rises by $\Delta t$, $$S=S_o+\Sigma_b\,\Delta t S_o \qquad \text{eqn 2}$$

and $$T=T_o+\Sigma_t\,\Delta t\,T_o. \qquad \text{eqn 3}$$

Subtracting eqn 3 from eqn 2

$$d=S-T=d_o-(\Sigma_t\,t_o-\Sigma_b S_o)\,\Delta t \qquad \text{eqn 4}$$

where $d_o\equiv S_o-T_o$

As long as the quantity in parentheses is not zero, the gap is temperature tunable. Since, in the preferred embodiment, $\Sigma_t$ is much larger than $\Sigma_b$, we simply choose a small initial gap, $d_o$, i.e., $S_o$ is about equal to $T_o$. Then eqn 4 becomes $$d=d_o-(\Sigma_t-\Sigma_b)T_o\Delta t \qquad \text{eqn 5}$$

Rearranging 5, $$(\Delta d/\Delta t)=-(\Sigma_t-\Sigma_b)T_o \qquad \text{eqn 6}$$

where $\Delta d=d-d_o$. Plugging values into equation 6 gives $$(\Delta d/\Delta t)=-(17.\times 10^{-5}\text{°C.}^{-1}-2\times 10^{-5}\text{°C.}^{-1})(0.06\ \text{in.})=$$

This relation will be appreciated by the skilled artisan.

This corresponds to a change of one-ten-thousandth of an inch per ten degree temperature rise. Although a faster rate of change of tolerance vs. temperature could be achieved by using thicker Teflon shoes, the current system has about a 10° C. spread between the best operating conditions and binding.

B. Wear:

The superiority of this design is closely linked with the seal's ability to tolerate wear. The wear in the seal is compensated for by thermal expansion in the shoes.

Compensation for wear is accomplished by increasing the nozzle temperature as calculated in the previous section. The effect of this temperature increase on the expansion temperature is insignificant, as is demonstrated by the following:

For any point in a supersonic expansion, the absolute temperature of the gas at that point is proportional to the absolute temperature of the nozzle. An increase of 10° C. of the absolute nozzle temperature (373 K=100° C.) corresponds to a relative increase in temperature of less than 3 percent:

$$(\Delta t/t'=(10\text{° C.}/373\text{ K})=2.7\%$$

Typically, the slit nozzle is probed at a point in the expansion corresponding to 30K. Hence a 10° C. temperature rise needed to maintain the sealing after ten thousandths of an inch of wear corresponds to a change in expansion temperature of less than 1 K. Such a small change in temperature would be of little consequence in most applications.

Since the original installation of the prototype, the slit seal has been in operation for over 6 months. In this time it has cycled an estimated ten million times and the sealing temperature has not been increased. An upper limit to the wear is estimated at 0.0001".

C. Advantages of the Sealing Technique:

The primary advantage of this sealing technique is the minimization of the static leak. A lower static leak gives a lower total flow rate of gas. For a given pumping efficiency, a lower flow rate permits the use of higher preexpansion pressure (which provides the advantage of greater cooling of rotations and vibrations) or a longer slit length (providing greater interaction length for the laser beam).

Another advantage of the sealing technique is that lubrication of the rotor is provided by the Teflon shoe which is chemically inert and doesn't need to be periodically replenished.

EXAMPLE 3

Duty Cycle

A major improvement in the current design is the ability to independently vary repetition rate and open time of the slit, which is afforded by reciprocating motion.

The product of the two quantities, repetition rate and open time per cycle, is the duty cycle, which is fixed for the case of the rotating mechanism, and variable for the case of the reciprocating mechanism.

A comparison of duty cycles for the two mechanisms is given below, using the following definitions:

W=slit width d=rotor diameter r=pulse repetition rate.

(a) Rotating Mechanism

For this case, the repetition rate r is equal to the number of revolutions of the inner cylinder per second. The open time $t_{open}$ is determined by the equation $$t_{open}=(w/\pi dr) \qquad \text{eqn 7}$$

Duty cycle D as defined above is $$D=t_{open}\, r \qquad \text{eqn 8}$$

From Eqn. 7, duty cycle is fixed by the rotor geometry, and independent of r:

$$D=(W/\pi d)$$

Since the duty cycle is fixed, the average throughput of the pulsed slit nozzle is independent of repetition rate. Because average throughput of a nozzle is limited by the pumping speed of the vacuum system, for a fixed duty cycle, there can be no trade-off between preexpansion pressure and repetition rate.

(b) Reciprocating Mechanism:

For this mechanism, a single electrical pulse causes a single sweep or stroke of the inner cylinder through a small angle, with a resultant single gas pulse at the midpoint of the stroke. The open time, $t_{open}$, is determined by $$t_{open}=(W/v)$$

where v is the tangential velocity of rotor at the time of opening. Note that v is completely independent of r since the rotor will come to rest at the end of a stroke and remain stopped for any specified period of time. Now the duty cycle is $$D=(rw/v),$$

and is clearly controllable by changing the repetition rate r or the velocity v. (The latter is controlled by changing the voltage and duration of the electrical pulse which drives the solenoid.)

Control over the duty cycle is desirable, since a smaller duty cycle means less total gas flow for constant slit dimensions and pre-expansion pressure, or, since available pumping speed is usually constant, an adjustable duty cycle means that one can decrease the repetition rate and increase the gas flow per pulse by raising the pre-expansion pressure.

In expansions which contain a polyatomic species seeded in a carrier gas, this results in better cooling of the rotational and vibrational motions of the polyatomic species, which is normally the reason for employing a supersonic expansion in the first place.

Also, raising the pre-expansion pressure can increase the formation of complexes (e.g., Van der Waals molecules) between the polyatomic molecule and the carrier gas; in many applications, such complexes are the systems of interest.

EXAMPLE 4

Direct Absorption Studies

Direct Absorption of jet-cooled samples is a difficult measurement to make. Low concentration and short pathlength both contribute to the small signal level. Beer's law $$A=elc$$

where A is absorbance, e is the molar extinction coefficient, 1 is pathlength, and c is concentration, shows that absorbance, A, is directly proportional to pathlength, 1, and concentration, c. The molar extinction coefficient, e, is a constant for a particular molecule at a specified wavelength and temperature.

The slit nozzle of the present invention was specifically designed to enhance the absorption signal by increasing the pathlength over that obtained from traditional pinhole nozzles. A measure of the increase in sensitivity due to an increase in pathlength is complicated by the fact that not only is the path length changed, but the concentration (which is linked to backing presure, flow rate and sample temperature) is not necessarily constant for the two cases.

A calculation of the increase in measured absorbance simply as a result of increased pathlength is strictly valid only for two nozzles of the same orifice area operating at the same duty cycle, sample temperature, preexpansion pressure and relative position of the point of measurement. A simple comparison of pathlength is then equivalent to the effect on absorbance as a result of stretching a round pinhole orifice into a long slit of equal area operating under the same duty cycle, temperature and backing pressure.

Theoretical treatments of the properties of two such nozzles give the result that the increase in pathlength is a function of the amount of cooling specified and the aspect ratio of the slit. For example, if the jets are probed at a point where the temperature is one-tenth the nozzle temperature, the pathlength provided by the slit is almost five times greater than that of the circular nozzle for an aspect ratio of 300.

An actual experimental comparison is given below for two nozzles which have been used with the same pumping system, although they were not operated at exactly identical conditions, as in the theoretical comparison above.

The two nozzles compared below are a 1 mm circular nozzle (the slit nozzle's predecessor in our laboratory) and the currently preferred embodiment (prototype).

The expansion from the 1 mm circular orifice was probed 2.7 nozzle diameters downstream. The pathlength at this point, calculated from supersonic fluid dynamics, is 4.3 mm.

The expansion from the 70 mm slit has a pathlength of 70 mm anywhere ini the vicinity of the nozzle. If the slit expansion is probed at the same degree of cooling the absorption signal should be enhanced by the factor of 16.

The absorbance from the 1 mm circular nozzle and the 70 mm slit have been measured and because the orifice area for the two nozzles are different (making necessary other changes in operating conditions) the enhancement of the absorbance signal actually observed is a factor of 11, which is evidence of the benefits of the slit nozzle.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A pulsed slit nozzle, useful for the generation of pulsed planar supersonic jets, which comprises:

(a) a concentric cylinder valve arrangement having two cylindrical members; a stationary outer cylinder member which is fitted with a pressurizable, rotatable inner cylinder member;

(b) each of the concentric cylinder members being provided with an axially extending slit formed parallel to the cylinder axis such that when the slits in each of the cylinder members are aligned they define a slit shaped nozzle orifice;

(c) means for providing reciprocating motion to the rotatable inner cylinder member;

(d) means for controlling gas pulse shape, duty cycle, repetition rate, and synchronization with other instrumentation; and (e) at least two different sealing materials, each having a different coefficient of thermal expansion, thus providing a temperature-tunable seal of the cylindrical valve arrangement.

2. The pulsed slit nozzle of claim 1, which further comprises at least one self-lubricating material in the sealing arrangement.

3. The pulsed slit nozzle of claim 1, which further comprises the use of a replaceable "shoe" in the seal.

4. The pulsed slit nozzle of claim 1, which further comprises means for heating the valve assembly.

5. The pulsed slit nozzle of claim 1, which further comprises means for the adjustment of the dimensions of the slit orifice.

* * * * *